US006652243B2

(12) United States Patent
Krasnov

(10) Patent No.: US 6,652,243 B2
(45) Date of Patent: Nov. 25, 2003

(54) METHOD AND APPARATUS FOR FILLING A STORAGE VESSEL WITH COMPRESSED GAS

(75) Inventor: Igor Krasnov, Houston, TX (US)

(73) Assignee: NEOgas Inc., Houston, TX (US)

( * ) Notice: Subject to any disclaimer, the term of this patent is extended or adjusted under 35 U.S.C. 154(b) by 0 days.

(21) Appl. No.: 10/226,416

(22) Filed: Aug. 23, 2002

(65) Prior Publication Data

US 2003/0039554 A1 Feb. 27, 2003

Related U.S. Application Data

(60) Provisional application No. 60/314,506, filed on Aug. 23, 2001.

(51) Int. Cl.[7] ..... F04F 11/00

(52) U.S. Cl. ..... 417/102; 417/103; 417/101

(58) Field of Search ..... 417/101, 102, 417/103, 92, 85

(56) References Cited

U.S. PATENT DOCUMENTS 2,478,321 A * 8/1949 Robbins ..... 417/103
4,304,527 A * 12/1981 Jewell et al. ..... 417/102
4,515,516 A 5/1985 Perrine et al.
4,547,132 A * 10/1985 Uchida et al. ..... 417/102
4,566,860 A * 1/1986 Cowan ..... 417/102
5,073,090 A * 12/1991 Cassidy ..... 417/102
5,387,089 A 2/1995 Stogner et al.
5,584,664 A * 12/1996 Elliott et al. ..... 417/386
5,771,693 A 6/1998 Coney
5,787,920 A 8/1998 Krasnov
5,884,675 A * 3/1999 Krasnov ..... 141/18
5,970,786 A 10/1999 Smith et al.
6,439,278 B1 * 8/2002 Krasnov ..... 141/197

FOREIGN PATENT DOCUMENTS

JP 56092381 A * 7/1981 ..... 417/103

* cited by examiner

*Primary Examiner*—Cheryl J. Tyler
(74) *Attorney, Agent, or Firm*—Bracewell & Patterson, L.L.P.

(57) ABSTRACT

A storage vessel is filled with compressed gas by filling a first tank with gas from a low pressure gas source. Hydraulic fluid is drawn from a reservoir and pumped into the first tank in contact with the gas. This causes the gas in the first tank to flow into the storage vessel as it fills with hydraulic fluid. At the same time, gas is supplied from the gas source to a second tank. Hydraulic fluid previously introduced into the second tank flows out to the reservoir as the second tank fills with gas. When the first tank is full of hydraulic fluid, a valve switches the cycle so that the hydraulic pump begins pumping hydraulic fluid back into the second tank while the first tank drains. The cycle is repeated until the storage vessel is filled with gas to a desired pressure.

20 Claims, 2 Drawing Sheets

METHOD AND APPARATUS FOR FILLING A STORAGE VESSEL WITH COMPRESSED GAS

This application claims the provisional filing date of application filed Aug. 23, 2001, Ser. No. 60/314,506 entitled "Wet Compressor System".

TECHNICAL FILED

This invention relates in general to equipment for compressing gas, and in particular to a system for compressing gas from a low pressure source into a storage vessel at a higher pressure.

BACKGROUND OF THE INVENTION

Compressed natural gas is used for supplying fuel for vehicles as well as for heating and other purposes. The gas is stored by the user in a tank at initial pressure of about 3,000 to 5,000 psi., typically 3600 psi. When the compressed natural gas is substantially depleted, the user proceeds to a dispensing station where compressed natural gas is stored in large dispensing tanks at pressures from 3,000 to 5,000 psi. The dispensing station refills the user's tank from its dispensing tank.

If the station is located near a gas pipeline, when the station's storage vessels become depleted, they can be refilled from the natural gas pipeline. For safety purposes, the pipeline would be at a much lower pressure, such as about 5 to 100 psi. This requires a compressor to fill the dispensing tank by compressing the gas from the gas source into the dispensing tank. Compressors are typically rotary piston types. They require several stages to compress gas from the low to the high pressure used for natural gas vehicle applications. These compressors generate significant amounts of heat which must be dissipated in inner cooling systems between the compression stages. These compressors may be expensive to maintain.

Also, in certain parts of the world, natural gas pipelines are not readily available. The dispensing stations in areas far from a pipeline or gas field rely on trucks to transport replacement dispensing tanks that have been filled by a compressor system at a pipeline. The same compressors are used at the pipeline to fill the dispensing tanks.

Hydraulic fluid pumps are used in some instances to deliver hydraulic fluid under pressure to a tank that contains gas under pressure. A floating piston separates the hydraulic fluid from the gas. The hydraulic fluid maintains the pressure of the gas to avoid a large pressure drop as the gas is being dispensed.

SUMMARY OF THE INVENTION

In this invention, gas is compressed from a gas source into a storage tank by an apparatus other than a conventional compressor. In this method, a first tank assembly is filled with gas from the gas source. Hydraulic fluid is drawn from a reservoir and pumped into the first tank assembly into physical contact with the gas contained therein. This causes the gas in the first tank assembly to flow into the storage reservoir as the first tank assembly fills with hydraulic fluid. The second tank assembly, which was previously filled with hydraulic fluid, simultaneously causes the hydraulic fluid within it to flow into a reservoir. The hydraulic fluid is in direct contact with the gas as there are no pistons that seal between the hydraulic fluid and the gas.

When the first tank assembly is substantially filled with hydraulic fluid and the second tank assembly substantially emptied of hydraulic fluid, a valve switches the sequence. The hydraulic fluid flows out of the first tank assembly while gas is being drawn in, and hydraulic fluid is pumped into the second tank assembly, pushing gas out into the storage vessel. This cycle is repeated until the storage vessel reaches a desired pressure.

DETAILED DESCRIPTION OF THE INVENTION

Figure 1:
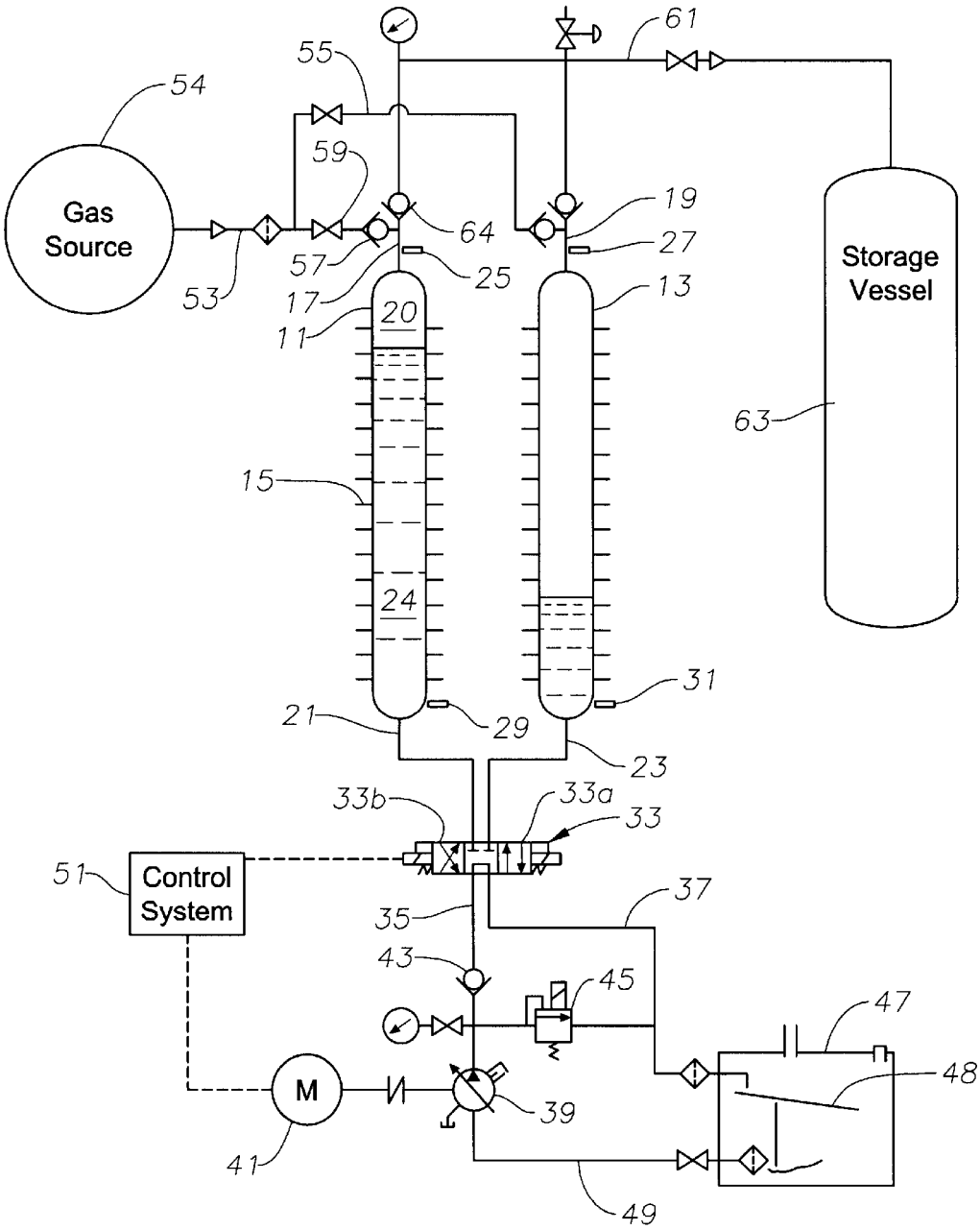
FIG. 1 is a schematic representation of a system constructed in accordance with this invention.

Referring to FIG. 1, first and second tanks 11, 13 are shown mounted side-by-side. Each tank is a cylindrical member with rounded upper and lower ends. Fins 15 optionally may be located on the exteriors of tanks 11, 13 for dissipating heat generated while their contents are being compressed. Tanks 11, 13 have gas ports 17, 19, respectively, on one end for the entry and exit of gas 20, such as compressed natural gas. Hydraulic fluid ports 21, 23 are located on the opposite ends of tanks 11, 13 in the preferred embodiment for the entry and exit of hydraulic fluid 24.

Hydraulic fluid 24 may be of various incompressible liquids, but is preferably a low vapor pressure oil such as is used in vacuum pumps. Preferably tanks 11, 13 are mounted vertically to reduce the footprint and also to facilitate draining of hydraulic fluid 24 out of hydraulic ports 21, 23. However vertical orientation is not essential, although it is preferred that tanks 11, 13 at least be inclined so that their gas ports 17, 19 are at a higher elevation than their hydraulic fluid ports.

Fluid level sensors 25, 27 are located adjacent gas ports 17, 19. Sensors 25, 27 sense when hydraulic fluid 24 reaches a maximum level and provide a signal corresponding thereto. Very little gas will be left in tank 11 or 13 when the hydraulic fluid 24 reaches the maximum level. Minimum fluid level sensors 29, 31 are located near hydraulic fluid ports 21, 23. Sensors 29, 31 sense when the hydraulic fluid 24 has drained down to a minimum level and provide a signal corresponding thereto. Fluid level sensors 25, 27, 29 and 31 may be of a variety of conventional types such as float, ultrasonic, or magnetic types.

A solenoid actuated position valve 33 is connected to hydraulic fluid ports 21, 23. Position valve 33 is shown in a neutral position, blocking any hydraulic fluid flow to or from hydraulic fluid ports 21, 23. When moved to the positions 33*a* or 33*b*, fluid flow through hydraulic fluid ports 21 or 23 is allowed. Position valve 33 is also connected to a fluid supply line 35 and a drain line 37. Fluid supply line 35 is connected to a hydraulic fluid pump 39 that is driven by motor 41. A check valve 43 prevents re-entry of hydraulic fluid 24 into pump 39 from supply line 35. A conventional pressure relief valve 45 is connected between supply line 35 and drain line 37 to relieve any excess pressure from pump 39, if such occurs. In this embodiment, pump 39 is a conventional variable displacement type. As the pressure increases, its displacement automatically decreases.

A reservoir 47 is connected to drain line 37 for receiving hydraulic fluid 24 drained from tanks 11, 13. Reservoir 47 is open to atmospheric pressure and has a line 49 that leads to the intake of pump 39. A splash or deflector plate 48 is located within reservoir 47 for receiving the flow of hydraulic fluid 24 discharged into reservoir 47. The hydraulic fluid 24 impinges on splash plate 48 as it is discharged. This tends to free up entrained gas bubbles, which then dissipate to atmosphere above reservoir 47.

When position valve 33 is in position 33*a*, pump 39 will pump hydraulic fluid 24 through hydraulic fluid port 21 into first tank 11. Simultaneously, hydraulic fluid 24 contained in second pump 13 is allowed to flow out hydraulic fluid port 23 and into reservoir 47. A control system 51 receives signals from sensors 25, 27, 29 and 31 and shifts valve 33 between the positions 33*a* and 33*b* in response to those signals.

A gas supply line 53 extends from a gas source 54 to gas port 17 of first tank 11. Gas source 54 is normally a gas pipeline or gas field that supplies a fairly low pressure of gas, such as between about 5 and 100 psi. A gas line 55 leads from gas supply line 53 to gas port 19 of second tank 13, connecting gas ports 17, 19 in parallel with gas source 54. Gas ports 17, 19 are continuously in communication with gas source 54 because valves 59 located between gas source 54 and gas port 17, 19 are normally in open positions.

A storage vessel line 61 extends from each of the gas ports 17, 19 to a storage vessel 63. Check valves 57 in lines 53 and 55 prevent any flow from tank 11 or 13 back into gas source 54. Check valves 64 mounted between storage vessel line 61 and gas ports 17, 19 prevent any flow from storage vessel 63 back into tanks 11, 13. Also, check valves 64 will not allow any flow from gas ports 17, 19 unless the pressure in gas ports 17, 19 is greater than the pressure in storage vessel line 61. Storage vessel 63 is capable of holding pressure at a higher level than the pressure of gas in gas source 54, such as 3,000 to 5,000 psi. Storage vessel 63 may be stationary, or it may be mounted on a trailer so that it may be moved to a remote dispensing site. Storage vessel 63 is typically a dispensing tank for dispensing compressed gas 20 into a user's tank.

In operation, one of the tanks 11, 13 will be discharging gas 20 into storage vessel 63 while the other is receiving gas 20 from gas source 54. Assuming that first tank 11 is discharging gas 20 into storage vessel 63, valve 33 would be in position 33*a*. Pump 39 will be supplying hydraulic fluid 24 through supply line 35 and hydraulic fluid port 21 into tank 11. Gas 20 would previously have been received in first tank 11 from gas source 54 during the preceding cycle. Hydraulic fluid 24 physically contacts gas 20 as there is no piston or movable barrier separating them. In order for gas 20 to flow to storage vessel 63, the hydraulic fluid pressure must be increased to a level so that the gas pressure in tank 11 is greater than the gas pressure in storage vessel 63. Gas 20 then flows through check valve 64 and line 61 into storage vessel 63.

Simultaneously, hydraulic fluid port 23 is opened to allow hydraulic fluid 24 to flow through drain line 37 into reservoir 47. The draining is preferably assisted by gravity, either by orienting tanks 11, 13 vertically or inclined. Also, the pressure of any gas 20 within second tank 13 assists in causing hydraulic fluid 24 to flow out hydraulic fluid port 23. When the pressure within tank 13 drops below the pressure of gas source 54, gas from gas source 54 will flow past check valve 57 into tank 13.

Pump 39 continues pumping hydraulic fluid 24 until maximum fluid level sensor 25 senses and signals controller 51 that hydraulic fluid 24 in tank 11 has reached the maximum level. The maximum level is substantially at gas port 17, although a small residual amount of gas 20 may remain. At approximately the same time, minimum level sensor 31 will sense that hydraulic fluid 24 in tank 13 has reached its minimum. Once both signals are received by control system 51, it then switches valve 33 to position 33*b*.

The cycle is repeated, with pump 39 continuously operating, and now pumping through fluid port 23 into second tank 13. Once the pressure of gas 20 exceeds the pressure of gas in storage vessel 63, check valve 64 allows gas 20 to flow into storage vessel 63. At the same time, hydraulic fluid 24 drains out fluid line 21 from first tank 11 into reservoir 47. These cycles are continuously repeated until the pressure in storage vessel 63 reaches the desired amount.

Ideally, the signals from one of the maximum level sensors 25 or 27 and one of the minimum level sensors 29 or 31 will be received simultaneously by controller 51, although it is not required. Both signals must be received, however, before controller 51 will switch valve 33. If a maximum level sensor 25 or 27 provides a signal before a minimum level sensor 27 or 29, this indicates that there is excess hydraulic fluid 24 in the system and some should be drained. If one of the minimum level sensors 29 or 31 provides a signal and the maximum level sensor 25, or 27 does not, this indicates that there is a leak in the system or that some of the fluid was carried out by gas flow. Hydraulic fluid should be added once the leak or malfunction is repaired.

A small amount of gas 20 will dissolve in hydraulic fluid 24 at high pressures. Once absorbed, the gas does not release quickly. It may take two or three days for gas absorbed in the hydraulic fluid to dissipate, especially at low temperatures when the hydraulic fluid viscosity increases. Even a small amount of gas in the hydraulic fluid 24 makes pump 39 cavitate and the hydraulic system to perform sluggishly.

If excess gas absorption is a problem at particular location, the release of absorbed gas 20 from the hydraulic fluid 24 can be sped up by reducing the molecular tension within the fluid. This may occur by heating the hydraulic fluid in reservoir 47 in cold weather. Also, the hydraulic fluid could be vibrated in reservoir 47 with an internal pneumatic or electrical vibrator. Splash plate 48 could be vibrated. A section of drain pipe 37 could be vibrated. Heat could be applied in addition to the vibration. Furthermore, ultrasound vibration from an external source could be utilized to increase the release of gas 20 from the hydraulic fluid 24. Of course, two reservoirs 47 in series would also allow more time for the gas 20 within the returned hydraulic fluid 24 to release.

Figure 2:
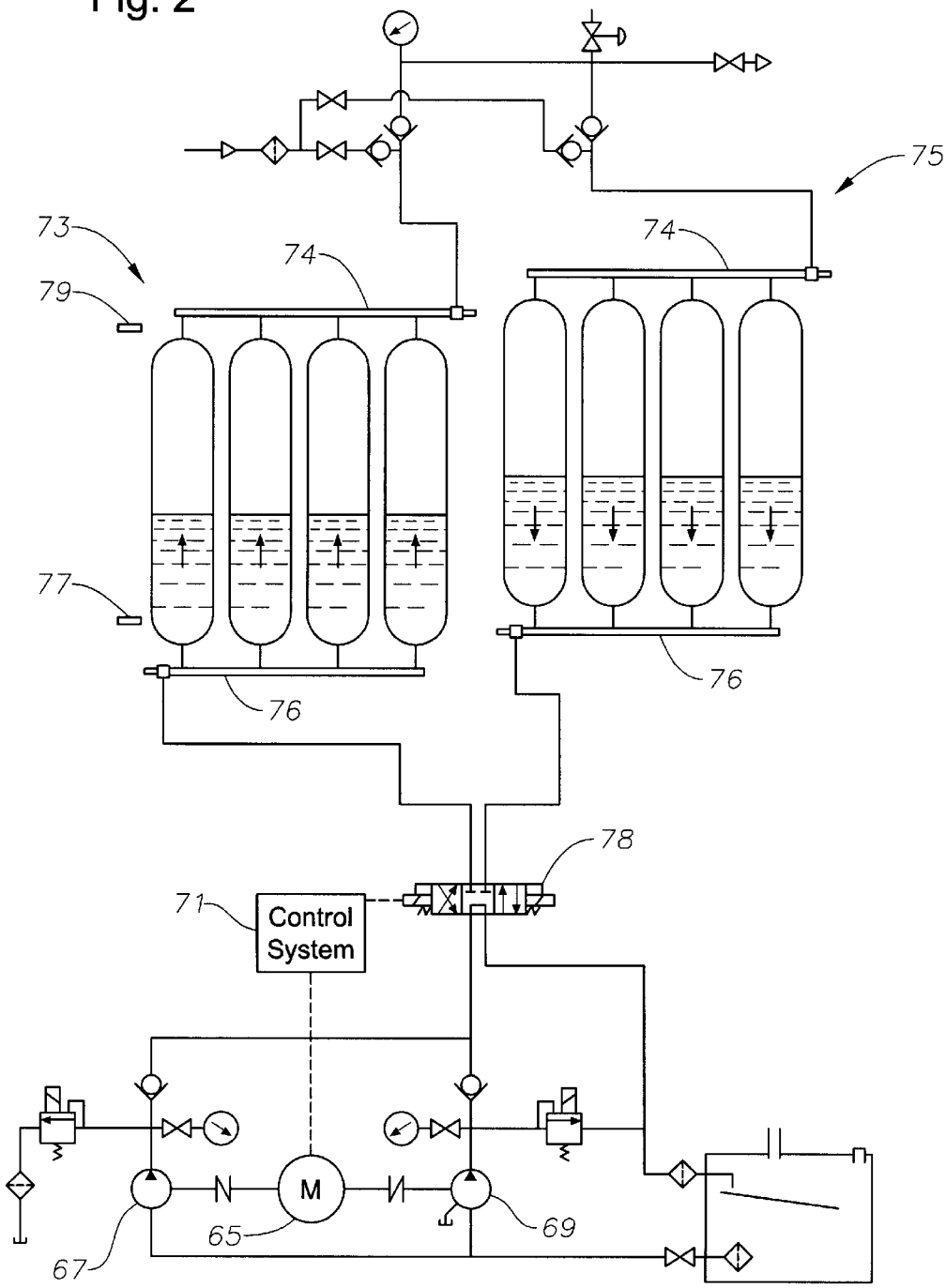
FIG. 2 is a schematic of an alternate embodiment of the system of FIG. 1.

FIG. 2 shows an alternate embodiment with two features that differ from that of the embodiment of FIG. 1. The remaining components are the same and are not numbered or mentioned. In this embodiment, rather than a variable displacement pump 39, two fixed displacement pumps 67, 69 are utilized. Pumps 67, 69 are both driven by motor 65, and pump 67 has a larger displacement than pump 69. Pumps 67, 69 are conventionally connected so that large displacement pump 67 will cease to operate once the pressure increases to a selected amount. Small displacement pump 69 continuously operates. Controller 71 operates in the same manner as controller 51 of FIG. 1. The two pump arrangement of FIG. 2 is particularly useful for large displacement systems.

The second difference in FIG. 2 is that rather than a single tank 11 or 13 as shown in FIG. 1, a plurality of first tanks 73 are connected together, and a plurality of second tanks 75 are connected together. The term "first tank assembly" used herein refers to one (as in FIG. 1) or more first tanks 11 or 73, and the term "second tank assembly" refers to one (as in FIG. 1) or more second tanks 75.

First tank assembly 73 comprises a plurality of individual tanks connected in parallel. Also, each of the tanks of second tank assembly 75 are connected in parallel. Each tank assembly 73, 75 has a gas port header 74 that connects all of the gas ports together. Each tank assembly 73, 75 has a hydraulic fluid head 76 that joins all of the lower ports. Consequently, each of the tanks within first tank assembly 73 or within second tank assembly 75 will fill and drain simultaneously. A single minimum fluid level sensor 77 is used for the first tank assembly 73, and a single minimum level sensor 77 is used for the second tank assembly 75. Only a single maximum level sensor 79 is needed for each of the tank assemblies, as well.

The embodiment of FIG. 2 operates in the same manner as the embodiment of FIG. 1 except that multiple tanks are filling and emptying of hydraulic fluid at the same time. Tank assemblies 73, 75 could be used with a variable displacement pump such as pump 39 in FIG. 1. Similarly, the two-pump system of FIG. 2 could be used with the single tank system of FIG. 1.

The invention has significant advantages. It allows compression of gas from a low pressure to a high pressure with a single stage. Less heat should be generated and less expenses are required.

While the invention has been shown in only two of its forms, it should be apparent to those skilled in the art that it is not so limited but susceptible to various changes without departing from the scope of the invention.

I claim:

1. A method for filling a storage vessel with compressed natural gas, comprising:

(a) substantially filling a first tank assembly with compressed natural gas from a gas source to a pressure greater than atmospheric; then (b) drawing hydraulic oil from a reservoir and pumping the hydraulic oil into the first tank assembly into direct contact with the gas contained therein, causing the gas in the first tank assembly to flow into a storage vessel as the first tank assembly fills with hydraulic oil;

(c) while step (b) is occurring, supplying compressed natural gas from the gas source to the second tank assembly to a pressure greater than atmospheric, the pressure of the gas in the second tank assembly causing any hydraulic oil in the second tank assembly to flow into the reservoir; then (d) when the first tank assembly is substantially filled with hydraulic oil and the second tank assembly substantially filled with gas and emptied of any hydraulic oil, performing step (b) for the second tank assembly and step (c) for the first tank assembly; and (e) repeating step (d) until the storage vessel is filled with gas to a selected pressure.

2. The method according to claim 1, further comprising removing from the hydraulic oil absorbed gas after the hydraulic oil has returned from the tank assemblies to the reservoir and prior to the hydraulic oil being pumped back into the tank assemblies.

3. The method according to claim 1, further comprising providing each of the tanks with a hydraulic oil port on one end for ingress and egress of the hydraulic oil and providing each of the tanks with a gas port on an opposite end for ingress and egress of the gas.

4. The method according to claim 1, wherein the first tank assembly becomes filled with hydraulic oil at a different time than the second tank assembly becomes emptied of hydraulic oil.

5. The method according to claim 1, further comprising detecting the event when the first tank assembly is full of hydraulic oil and the event when the second tank assembly is emptied of hydraulic oil, then beginning to pump hydraulic oil into the second tank assembly only after both events have occurred, the events occurring at different times.

6. The method according to claim 1, further comprising:

exposing the hydraulic oil in the reservoir to atmospheric pressure.

7. The method according to claim 1, wherein the pumping of step (b) is performed by a variable displacement pump that reduces displacement as the pressure in the storage vessel increases.

8. The method according to claim 1, wherein:

step (a) comprises simultaneously pumping hydraulic oil at the same flow rates and pressures into a plurality of first tanks connected together in parallel, defining the first tank assembly; and step (c) comprises simultaneously filling with gas a plurality of second tanks connected together in parallel, defining the second tank assembly.

9. The method according to claim 1, wherein the pumping of step (b) is performed by two pumps of differing displacements, the pump with a larger displacement than the other pumping until the pressure of the gas in the storage vessel reaches a set level, then shutting off the pump with the larger displacement, and by the pump with the smaller displacement alone afterward until reaching the selected pressure in the storage vessel.

10. An apparatus for filling a storage vessel with a compressed natural gas, comprising:

first and second tank assemblies, each of the tank assemblies adapted to be connected to a gas source for receiving compressed natural gas and to a storage vessel for delivering gas at a higher pressure than the pressure of the gas of the gas source, the tank assemblies being free of any pistons;

a reservoir containing a quantity of hydraulic oil, the reservoir being connected to the tank assemblies and being open to atmospheric pressure;

a pump having an intake connected to the reservoir for receiving the hydraulic oil and an outlet leading to the tank assemblies; and a position valve connected between the reservoir and the tank assemblies and between the pump and the tank assemblies for alternately supplying hydraulic oil to one of the tank assemblies and draining hydraulic oil from the other of the tank assemblies to the reservoir, the hydraulic oil being pumped coming into contact with the gas contained within each of the tank assemblies for forcing the gas therefrom into the storage vessel.

11. The apparatus according to claim 10, wherein the tank assemblies are vertically mounted with their upper ends connected to the storage vessel and also to the gas source and their lower ends connected to the position valve.

12. The apparatus according to claim 10, further comprising at least one check valve that prevents flow from the tank assemblies to the gas source.

13. The apparatus according to claim 10, wherein each of the tank assemblies comprises a plurality of tanks connected together in parallel.

14. The apparatus according to claim 10, further comprising:

a pair of sensors for each of the tank assemblies, one of the sensors in each pair sensing when the hydraulic oil reaches a selected maximum level in the tank assemblies and providing a signal, and the other of the sensors in each pair sensing when the hydraulic oil reaches a selected minimum level in the tank assemblies and providing a signal; and a controller that receives the signals from the sensors and changes the position of the position valve in response thereto once both of the signals have been received.

15. The apparatus according to claim 10, further comprising:

a degassing device cooperatively associated with the reservoir for removing absorbed gas in the hydraulic oil being returned to the reservoir.

16. A system for filling a storage vessel with a gas, comprising:

a gas source for supplying compressed natural gas at a pressure greater than atmospheric;

first and second tank assemblies, each of the tank assemblies having a gas port on one end and a hydraulic oil port on the other end, the tank assemblies being free of any pistons between the ends;

a gas source line leading from the gas source to each of the gas ports for supplying gas to the first and second tank assemblies;

a check valve in the gas source line to prevent flow from the first and second tank assemblies back to the gas source;

a storage vessel;

a storage vessel line leading from each of the gas outlets to the storage vessel for delivering gas from the first and second tank assemblies to the storage vessel;

a check valve in the storage vessel line to prevent flow from the storage vessel back to the first and second tank assemblies;

a position valve connected to the hydraulic oil ports of the tank assemblies;

a reservoir for containing hydraulic oil the reservoir having a receiving line connected to the position valve for receiving hydraulic oil from each of the tank assemblies depending upon the position of the position valve, the reservoir being open to atmospheric pressure;

a pump having an intake in fluid communication with the reservoir and an outlet line leading to the position valve for pumping hydraulic oil into each of the tank assemblies into direct contact with the gas contained therein, depending upon the position of the position valve; and a controller having a sensor that senses when the first tank assembly has reached a maximum level of hydraulic oil, and shifts the position valve to supply hydraulic oil from the pump to the second tank assembly and to drain hydraulic oil from the first tank assembly to the reservoir, the entry of the hydraulic oil into the second tank assembly forcing the gas to flow from the second tank assembly to the storage vessel, the draining of hydraulic oil from the first tank assembly allowing gas from the gas source to flow into the first tank assembly.

17. The system according to claim 16, wherein the tank assemblies are mounted with their gas ports at a higher elevation than their hydraulic oil ports for draining hydraulic fluid from the tank assemblies with the assistance of gravity.

18. The system according to claim 16, further comprising a degassing device cooperatively associated with the reservoir for removing absorbed gas in the hydraulic oil flowing into the reservoir.

19. The system according to claim 16, wherein the pump is a variable displacement pump.

20. The system according to claim 16, wherein the pump comprises a pair of fixed displacement pumps connected in parallel with each other, one having a larger displacement than the other.

* * * * *